United States Patent [19]

Goodman

[11] Patent Number: 4,586,493

[45] Date of Patent: May 6, 1986

[54] THERAPY TABLE

[76] Inventor: Charles J. Goodman, 2955 N. Moorpark Rd., Thousand Oaks, Calif. 91360

[21] Appl. No.: 531,942

[22] Filed: Sep. 13, 1983

[51] Int. Cl.[4] ..... A61H 15/00

[52] U.S. Cl. ..... 128/57; 128/33; 128/24.3

[58] Field of Search ..... 128/57, 33, 70, 34, 128/35, 36, 25 R, 24.3, 51, 52; 74/590

[56] References Cited

U.S. PATENT DOCUMENTS

| | | | |
|---|---|---|---|
| 2,781,040 | 2/1957 | Hill . | |
| 2,995,048 | 8/1961 | Mitchell et al. | 74/590 |
| 3,003,497 | 10/1961 | Nunes | 128/33 X |
| 3,039,458 | 6/1962 | Hill . | |
| 3,640,272 | 2/1978 | Hussey . | |
| 3,664,333 | 5/1972 | Hill . | |
| 3,812,846 | 5/1974 | Trout . | |
| 3,830,233 | 8/1974 | Hill . | |
| 3,877,422 | 4/1975 | Heuser et al. | 128/57 |
| 3,882,856 | 5/1975 | Heuser et al. | 128/57 |
| 4,167,182 | 9/1979 | Yamamura . | |
| 4,280,354 | 7/1981 | Wheeler . | |
| 4,405,128 | 9/1983 | McLaughlin et al. | 272/117 |

*Primary Examiner*—Richard J. Apley
*Assistant Examiner*—Robert W. Bahr
*Attorney, Agent, or Firm*—Koppel & Harris

[57] ABSTRACT

The therapy table has a supporting surface for supporting a patient. A carriage below the supporting surface carries a roller mechanism that acts on the body. A motor translates the carriage relative to the supporting sruface, and the patient. A counterbalance arm including a mass mounted on the arm urges the rollers against the patient at a predetermined force. The mass is adjustable along the counterbalance arm to adjust the movement of the mass acting on the counterbalance arm for adjusting the force of the rollers against the patient.

12 Claims, 5 Drawing Figures

THERAPY TABLE

BACKGROUND OF THE INVENTION

1. Field of the Invention

This invention relates to a therapy table useful primarily in chiropractic medicine for spinal treatment.

2. Prior Art

Chiropractic is the science concerned with the relationship between body structure, principally the spine and the nervous system and its effect on the body and the function of the body's systems.

Although back pain is normally thought of as the major symptoms of spinal problems, degeneration of the vertebrae and discs and misalignment of the spine is believed to be a cause of many health problems. Nerves branching from the spinal cord and blood vessels pass through intervertebral foramen, the openings between vertebrae. Spinal misalignment may change the shape of the openings or make them smaller, which causes neurothlipsis, pressure on the nerve.

The science of chiropractic teaches manipulation of the vertebrae with the goal of reaching a correct alignment of the spine. A skilled chiropractor may use his or her hands to effect manipulation. Some treatment, however, is best done slowly or at a certain repeated frequency by machines. Determining which conditions benefit most from the latter treatment is also a function of a skilled chiropractor.

A main back problem is caused by disc degeneration. Discs are the cartilage between each of the vertebrae allowing flexibility to the spine and acting as a shock absorber. Through trauma, improper posture, long days of sitting and lack of exercise, discs loose their cushioning and flexibility effects, and they may deteriorate to a position allowing adjacent vertebrae to contact and rub against the nerve. This is quite painful. For discs to remain healthy, it is believed that regular exercise is important because the alternate stretching and cushioning by the discs causes increase circulation and intercellar fluid to be "pumped" into the disks.

It has been recognized that moving a correctly positioned roller longitudinally relative to the spine may retard disc degeneration and may actually repair damaged disks through the increased circulation and pumping action.

A normal spine curves from front to back, and the curve changes between the cervical, thoracic and lumbar areas of the spine. Previous therapy tables that had moving parts rolling along the spine are often spring mounted so that the rollers can conform to the curve of the spine. Hussey, U.S. Pat. No. 3,640,272 (1972) discloses such a spring mount. Springs change the force applied based upon distance between the rollers and their support. Thus, as the spine curves away from the surface of a therapy table and the spring cause the rollers to follow the spine, the force applied in that area will be less than in the areas where the spine is closer to the table.

Programmability of the table is desirable. Although many prior art tables are adjustable, each requires patient measurement before adjustment. Because the tables can operate without close supervision by a chiropractor, it would be desirable if the patient could affect programming of the table based on the specifications dictated by the chiropractor.

Although keeping constant pressure on the various portions of the back may be desirable, it would also be desirable to apply different forces to different areas of the back, which would require changing the force during translation of the rollers. For simplicity of operation, the force adjustment should occur automatically without the need for an operator to monitor force levels and change them manually.

Vibrating the rollers in contact with the back has been found to have therapeutic effects, but it is believed that it is the vertical component of the vibrations (i.e. movement generally toward and away from the surface of the back) that is useful and that the horizontal component of vibration is actually counter-productive. It would be desirable to eliminate the horizontal oscillations.

SUMMARY OF THE INVENTION

The principal object of the present invention is to provide the desirable features previously discussed and to eliminate many of the problems accompanying prior art devices.

The therapy table of the present invention has a supporting surface on which a patient lies supine. The body acting member which preferably includes one or more rollers mounted on a carriage below the supporting surface acts on the body. A motive system below the supporting surface moves the body acting member relative to the supporting surface and the body. The rollers act on the body through an opening in the support surface that may be covered by relatively flexible material. The therapy table has been improved by having a counter balanced arm operably attached to the roller for urging the rollers against the body.

The counter-balance includes an arm extending generally horizontally and connected to a linkage. The weight on the mass acting through the linkage urges the carriage and its rollers vertically upward. An adjusting system is provided for moving the mass along the arm to adjust the moment arm which in turn adjusts the force of the rollers against the back. The mass adjusting system can be controlled during translation of the rollers so that the force acting on the back can be adjusted during translation.

The roller support has two parallel plates that are journaled to support the rollers. The plates are supported by two posts attached to a lower plate. A vibrating motor rests on the lower plate. One of the arms of the linkage is attached to the parallel plates of the roller support through an elongated, vertically aligned slot so that the vertical oscillations of the vibrating motor are transmitted to the upper plates and the rollers, but the horizontal oscillations are damped.

A microprocessor is associated with the therapy table and controls the force of the rollers acting on the back, the length of travel of the rollers, any changes in the force of the rollers for different positions, the rate of travel of the rollers and other functions. The carriage has an optical sensor that moves with the carriage adjacent to an internal surface of the table that has alternating back and reflecting areas. The microprocessor counts the alternating dark and reflecting areas, compares it to a stored, initial position indicator and converts the counted pulses into position data that the microprocessor uses in controlling the rollers.

Figure 1:
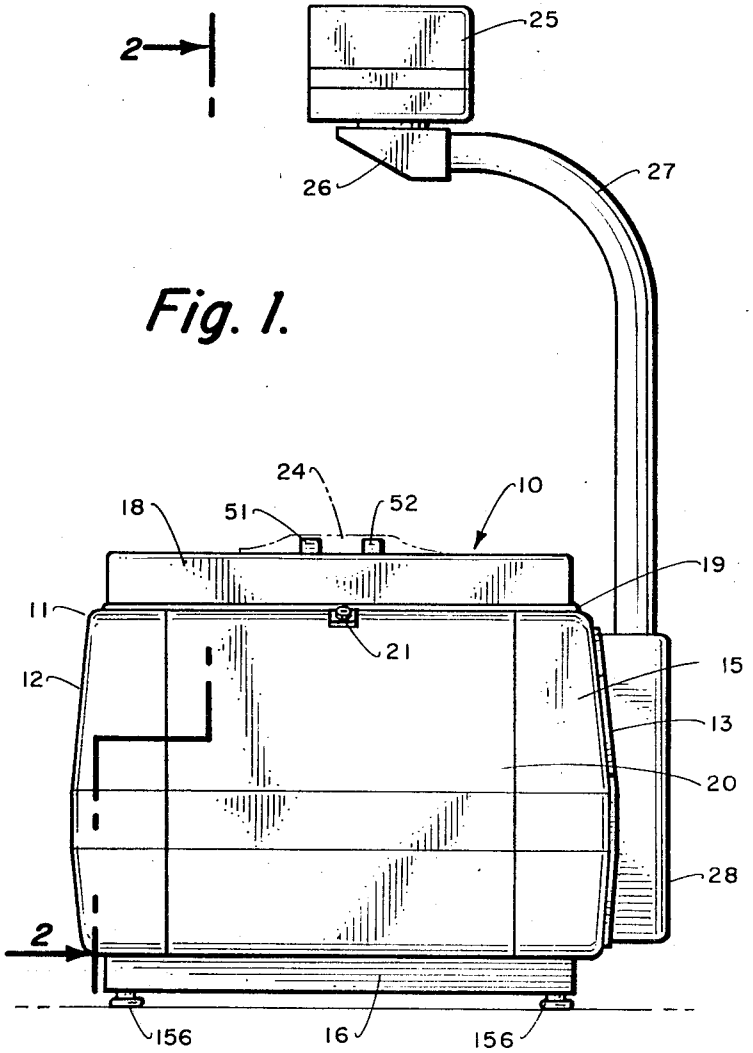
FIG. 1 is an end elevation of the therapy table of the present invention.

The therapy table of the present invention has a supporting surface 10 (FIGS. 1, 2, 3 and 4) as the top surface of housing 11. Housing 11 is generally rectangular in form and has curved vertical walls 12, 13, 14 and 15 (FIGS. 1 and 2) for aesthetic reasons. Walls 12–15 may be formed of rigid plastic or sheet metal. The surface may be painted or covered in plastic material. Housing 11 rests on base 16, which has adjustable feet 156 for resting on the floor. Supporting surface 10 is the top surface of pad 18, which is preferably formed of foam rubber for comfort to patient 1. Cover 18 is positioned inside ring 19 around the upper portion of housing 11 to position pad 8 as show in FIGS. 1 and 2. Pad 18 can be removed from its position for access to the cavity inside of housing 11. Additionally one or more of the wall 12–15 may have a door for access into the cavity. One such door 20 is shown in FIG. 1, which extends through wall 15. Door 20 is closed by latch 21.

Figure 2:
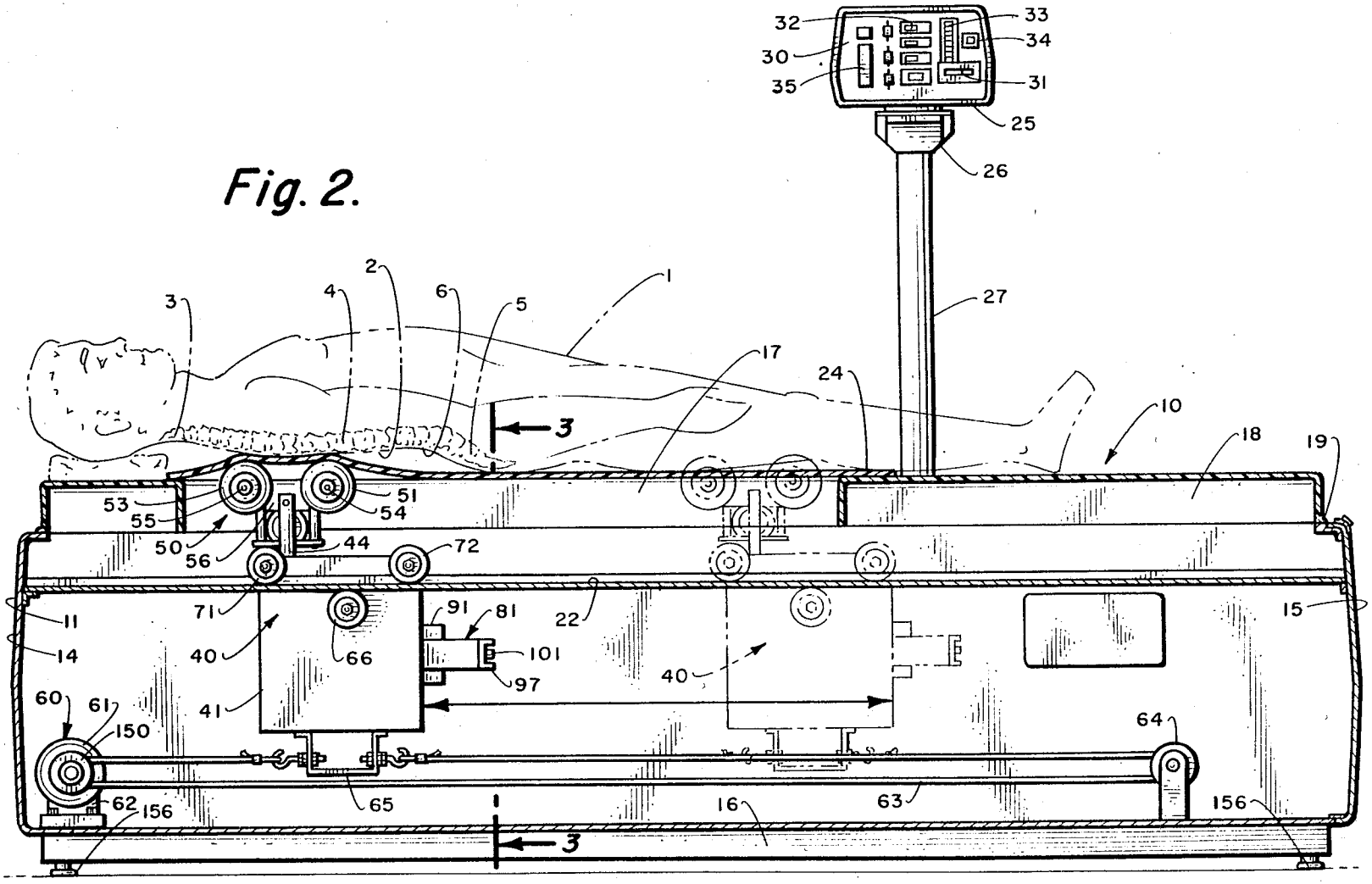
FIG. 2 is a side elevation partially in section of the therapy table of the present invention taken through plane 2—2 of FIG. 1 and shows a patient lying supine on the table.

A controller is associated with the therapy table for controlling its operation. Much of the control is carried on electronically by a microprocessor (FIG. 5) housed in control housing 25 (FIGS. 1 and 2). The control housing is mounted to pivot on bracket 26 on curved arm 27. The bottom of curved arm 27 extends into bracket 28 that is intragally formed on wall 13. Arm 27 may pivot to a limited degree in bracket 28 from the position shown in FIG. 1 to positions in which the control housing is not directly above supporting surface 10. Control housing 25 may pivot between the position shown in FIG. 2 where its front panel 30 will normally be visible to the chiropractor or the person programming or initiating the operation of the machine to a position facing to the left in FIG. 2 where it can be viewed by patient 1. The operation of the controller is described below.

The therapy table of the present invention includes body acting means part of which is positioned below the supporting surface 10 for acting on the body. In the exemplary embodiment, body acting means includes a carriage 40 (FIGS. 2–4), which moves along the back of the patient 1.

Motive means 60 move the carriage horizontally relative to supporting surface 18. In the exemplary embodiment, the motive means comprises a motor 61 (FIGS. 1 and 2) mounted on a bracket 62 on base 16. Motor 61 rotates a pulley 150 that drives cable 63. The cable extends around idler pulley 64 (FIG. 2), and the ends of cable 63 attach to bracket 65 (FIG. 2), which in turn is attached to the underside of shell 41 around a portion of a carriage 40. Although a cable and pulleys are used in the exemplary embodiment, a chain, belt threaded or other drive is most acceptable. Rotation of motor 61 pulls one end of cable 63 to move shell 41 and carriage 40 horizontally.

Figure 3:
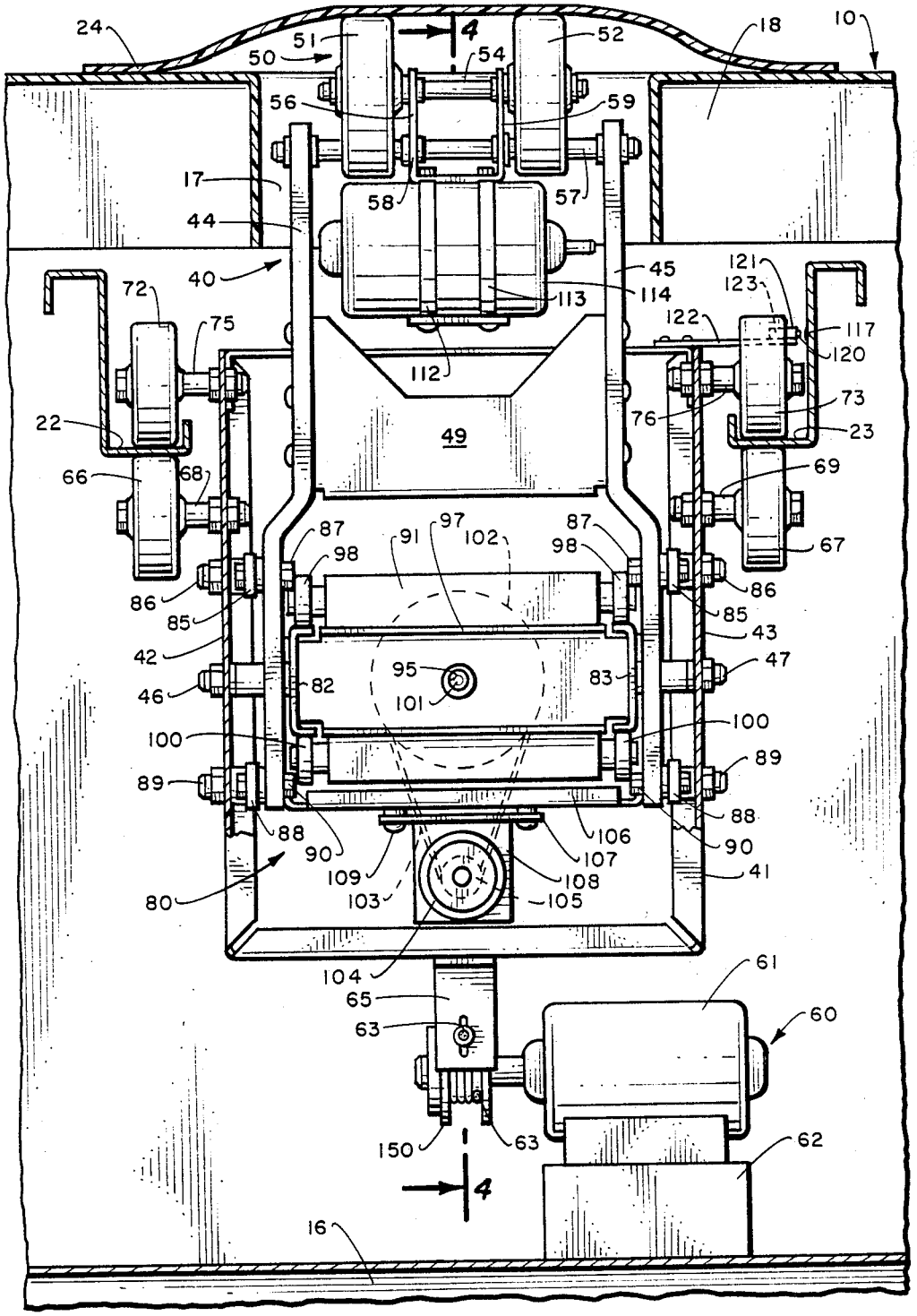
FIG. 3 is a sectional view taken through plane 3—3 of FIG. 2 showing the details of the parts that act on a person's back.

Shell 41 (FIGS. 2–4) is preferably formed of sheet metal open on one side (FIG. 3). A pair of lower wheels 66 and 67 are attached to side walls 42 and 43 of shell 41 by means of axles 68 and 69 (FIG. 3). Two pairs of upper wheels 71–74 (FIGS. 2, 3 and 4) are mounted in a similar fashion as lower wheels 66 and 67. Upper wheels 72 and 74 are mounted by axles 75 and 76 (FIG. 3) attached in conventional fashion to side walls 42 and 43 of shell 41. Preferably, for elimination of noise, wheels 66, 67, 71, 72, 73 and 74 are either formed of nylon or are coated in a soft material.

Figure 4:
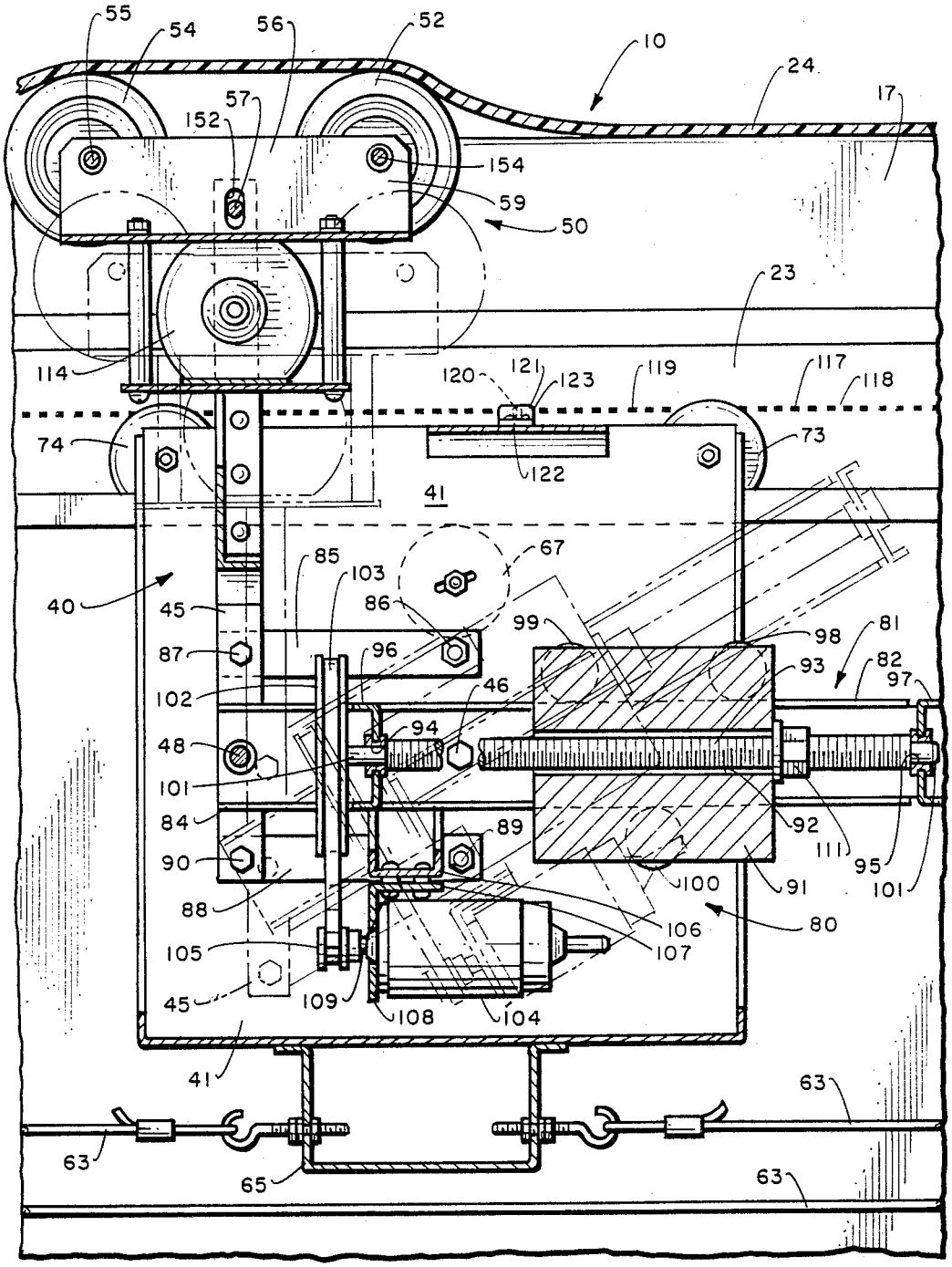
FIG. 4 is another sectional view taken through plane 4—4 in FIG. 3 of the details of the parts of the present invention that act on a person's back.

The two pairs of upper wheels, 71–74 are in the same horizontal plane and support the body acting means on rails 22 and 23 (FIG. 3). The rails are shaped as shown in FIG. 3, and they are attached to structure (not shown) within housing 11 in conventional manner. Lower wheels 66 and 67 are mounted intermediate to the upper wheels and are in contact with the bottom of rails 22 and 23 (FIGS. 2–4). Lower wheels 66 and 67 prevent the carriage from vibrating off rails 22 and 23 and also prevent the entire carriage 40 from being pivoted with respect to the rollers.

The carriage also includes a roller assembly 50 (FIGS. 2–4) mounted at the upper portion of carriage 40. Two pairs of rollers 51, 52, 53 and 54 (FIGS. 2–4) are mounted by axles 154 and 55 extending through U-shaped bracket 56. The rollers may be formed from many different materials including rubbers and plastics. As set forth below, patient 1 is positioned as shown in FIG. 2, and the rollers 51, 52, 53 and 54 move with the carriage 40 to move along the patient's spine from a predetermined starting position to a predetermined ending position, returning back to the start and repeating. The lateral spacing of the rollers (e.g. rollers 51 and 52 in FIG. 3) is such that the rollers travel along the sides of the spine. Depending on the treatment prescribed by the chiropractor, the rollers may move between the cervical area 3 (FIG. 2) past the thoracic region 4 and then to the lumbar area 5, or if the condition warrants, only one or two of the areas can be treated. In FIG. 2, the carriage 40 is shown moving between two quite distant longintudinal locations. In solid, the rollers are between the cervical and the thoracic areas. In phantom, carriage 40 is shown under a portion of the legs. Although the therapy table of the present invention can be built to go as far to the right as is shown in FIG. 2, normally, the distance that it travels will be much shorter. The two positions are shown far apart for clarity in the drawings.

Pad 18 has a central opening 17 (FIGS. 2 and 3) through which the upper portion of roller assembly 50 extends to be in contact with the patient's back 2. Opening 17 should not be accessible to the patient for safety reasons. An arm, leg, or other body part inserted into opening 17 when the machine is in operation could be damaged by the moving carriage 40 or by any of the other moving components. Therefore, a relatively heavy, yet flexible cover 24 is over opening 17, but as shown in FIGS. 2 and 3 as the roller assembly 50 is under a specific location of cover 24, that portion of the cover moves upward until it contacts the patient's back so that it transmits the force from rollers 51–54 to the patient's back. When the roller assembly 50 moves away from a given horizontal position, the cover 24 will drop until it is lying parallel with supporting surface 10 on pad 18. Cover 24 should be rigid enough so that it does not fall substantially into opening 17, and its edges should extend outward a sufficient distance beyond opening 17 to support cover 24 in a generally flat position. Because cover 24 is formed of a relatively heavy material, it will not easily be removed from over opening 17 as the patient moves on and off of the therapy table. Some type of fasteners, which allow limited movement, may also be provided for securing cover 24 to the top of pad 18.

As previously discussed, a deficiency of prior devices is that most of the roller assemblies are spring biased against the back to allow them to conform to a curved spine. As can be seen in FIG. 2, the back 2 of patient 1 is not perfectly flat on supporting surface 18 because the spine normally curves between the cervical, thoracic and lumbar areas. If the roller assembly 50 were spring mounted, it would apply a greater force to the region where it is shown in FIG. 2 than it would if it were in contact with the curved portion 6 because the greater distance would change the force on a spring.

The present invention has been improved by having the weight of a counterbalanced arm urging the body acting means against the body. In the exemplary embodiment, the counterbalanced arm mechanism 80 includes a horizontal arm 81 formed of two C-shaped channel members 82 and 83 (FIGS. 3 and 4). Near their left end (FIG. 4) the channel members are mounted on bolts 46 and 47 (FIG. 3) to pivot with respect to the shell walls 42 and 43. Pivot bolt 48 (FIG. 4) connects a forward extension 84 of horizontal arm 81 (FIG. 4) to pivot with respect to generally vertical support arms 44 and 45 (FIG. 2–4). Additionally, an upper pair of linkages 85 are connected by pivot pins 86 to the shell side walls 42 and 43 and by pivot pins 87 to support arms 44 and 45. A lower linkage 88 is likewise connected by pivot pins 89 to side walls 42 and 43 of shell 41 and by pivot pins 90 to the lower portion of support arms 44 and 45. As the patient's back urges roller assembly 50 downward horizontal arm 81 pivots about pivot point 46 (FIG. 4) to the phantom position. The linkage arrangement maintains support arms 44 and 45 in a vertical position. The support arms move slightly to the right (FIG. 4), but the main component of the force from counter-balance arm 81 is to urge roller assembly 50 upward against the back.

A mass is provided on horizontal arm 81 to act as a counter-balance. In the exemplary embodiment, mass 91 is formed of a heavy material such as steel. Mass 91 has a hollow central opening 92 through which threaded shaft 93 extends. The ends of threaded shaft 93 are journaled into openings 94 and 95 of brackets 96 and 97, which are anchored to C-shaped channel members 82 and 83 (FIG. 4). End 101 of threaded shaft 93 is rotated by motor 104 in a manner described below.

A pair of upper rollers 98 and 99 (FIGS. 3 and 4), which are attached to an upper portion of mass 91 roll along the upper surface of channel members 82 and 83, and a lower pair of rollers 100 roll along the bottom of the C-shaped channel members (FIGS. 3 and 4) so that the mass can move horizontally relative to horizontal arm 81. When the force that the roller assembly 50 applies to the back is to be changed, the moment arm of horizontal arm 81 is changed by moving the mass along horizontal arm 81. As shown primarily in FIG. 4, the front or left (FIG. 4) portion 101 of threaded shaft 93 extends through journal opening 94 where it connects and is fixed to pulley 102. A belt 103 connects pulley 102 to output pulley 105 of motor 104. FIG. 4 shows that motor 104 is mounted on motor support 108 that depends from bracket 107 attached to lower cross brace 106. Bolt 109 secures cross brace 106 to the lower portions of support arms 44 and 45 to brace the support arms.

Motor 104 is a reversing motor. As it rotates in one direction, it causes belt 103 to drive pulley 102 and rotate threaded shaft 93 in one direction. Threaded nut 111, which is fixed to the right end (FIG. 4) of mass 91, moves along threaded shaft 93 as the shaft rotates and carries with it mass 91. Thus, by controlling the motor 104, the position of mass 91 along horizontal arm 81 can be controlled, and the force that the rollers 51–54 apply to the back is also controlled. Because motor 104 travels with the rest of carriage 40 as it moves laterally relative to the patient, the actual position of mass 91 can be constantly controlled so that a different amount of force could be applied to different areas of the back.

In addition to the lower brace 106 that holds the lower portion of support arms 44 and 45 apart, an intermediate brace 49 (FIG. 3) and shafts associated with roller assembly 50 secure the intermediate and upper portions of support arms 44 and 45 at a fixed distance apart.

An upper shaft 57 is anchored to the upper portions of support arms 44 and 45 (FIG. 3) and extends through elongated slots 152 in side walls 58 and 59 of bracket 56 (FIG. 4). A pair of motor mounts 112 and 113 depend downward from bracket 56 to support vibrator motor 114 in the position shown best in FIG. 3. Motor 114 vibrates and causes the roller assembly 50 to vibrates, but because of the shape of elongated slot 152, horizontal oscillations are prevented, and the systems is limited to vertical oscillations. Therefore, rollers 51–54 vibrates vertically and create the desired therapeutic effect to the patient.

A control system is necessary for controlling all of the operations of the table. One important piece of information necessary for control is the position of the carriage 40 relative to the patient. The position determining means of the present invention comprises a strip of alternating, reflecting and non-reflecting regions. In the exemplary embodiment, the strip 117 is painted or otherwise formed on channel member 23 (FIG. 3). Strip 117 has alternating reflective regions 118 and non-reflective regions 119. A light source 120 mounted in housing 121 (FIG. 4) on a horizontal bracket 122 extending from shell 41 moves along with movement of the carriage 40. Light reaching non-reflective areas 119 is absorbed, but as the carriage translates, the light is reflected from each reflective region 118, and the light can be sensed by sensor 123 mounted in housing 121. As the carriage 40 moves horizontally, the alternating reflective and non-reflective regions on strip 117 sends a series of pulses, and a circuit (not shown) counts the number of pulses. Because each reflective and non-reflective region are of equal lengths, the number of pulses counted gives an accurate representation of the distance that the carriage has traversed. By setting a nominal zero position, when main drive motor 61 drives the carriage in one direction, the pulses are added to the zero position to determine a position at a given time. When drive motor 61 is reversed, the pulses are subtracted from the last position so that the displacement is always known.

The therapy table of the present invention is programmable for maximum therapeutic affect. Desirably, programing is affected automatically through a punch card or similar data entry system. As shown in FIG. 2, control housing 25 has a slot 31 through panel 30 that receives a card. The information for a particular patient can be encoded magnetically on the card, or a simple punch card can be used. Typically, the information on the punch card would include such data as the starting position and final position for the rollers, the speed of traverse between the two points (and any changes in intermediate speed), the force to be applied and any possible changes in the force relative to position and vibration rates. The number of cycles can also be programmed, or conversely, the time that the therapy table runs may be programmed. Buttons 32 allow for manual programming. Panel 30 also has a series of operating lights 33 to show the operating condition at any time for the therapy table. Preferably, a start button 34 is also provided. There will normally be a delay after the start button is actuated to allow the patient to assume a proper position on the therapy table. In addition to the portion of the panel that controls the operation of the therapy table, the panel may also have a tape player 35 where cassette music or other tapes can be inserted for other forms of therapy while the therapy table is acting on the patient. An emergency switch (not shown) may also be provided on one of the vertical walls 12 or 13 near the patient's hand so that without sitting up, the patient can stop the machine.

Note that housing 25 pivots on bracket 26. In FIG. 2 it is shown facing the person who would program it, but when the patient is on the table, the housing will normally be pivoted 90 degrees so that the patient can view panel 30 and its associated lights and controllers.

Figure 5:
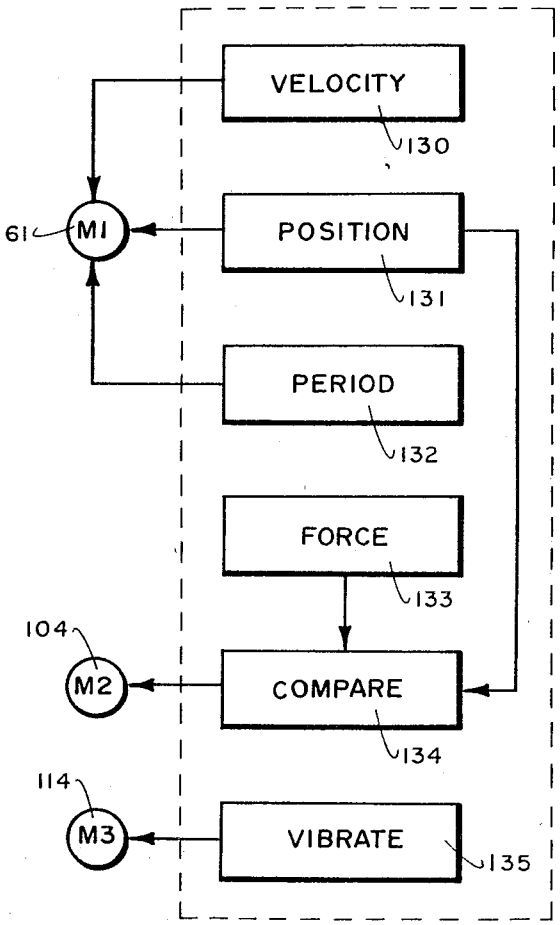
FIG. 5 is a schematic of the control system of the present invention.

Turning to FIG. 5, a schematic of the controller is shown. Six functions are initially controlled by the program. When the program determines that the carriage 40 is to move at a particular velocity, block 130 is the velocity controller, and it signals motor M1 (61) to rotate at a certain speed so that carriage 40 moves at a particular velocity. Likewise, position block 131 signals motor 61 to start and stop at a particular position. Block 132 also controls motor M1 (61) for the length of time that the system operates or the number of times that the body acting means 40 translates.

The force that is set (block 133) can go directly to motor M2 (104), but because the force from the rollers may be position dependent, the position information from block 131 and the force information from block 133 is compared at 134 to control motor M2. The programming of block 135 controls the vibrating motor 114 (M3).

Various modifications and changes may be in the configuration described above that come within the spirit of this invention. The invention embraces all such changes and modifications coming within the scope of the appended claims.

I claim:

1. In a therapy table comprising a supporting surface for supporting the body of a person to be treated, body acting means at least a portion of which is below the supporting surface for acting on the body, motive means below the supporting surface for moving the body acting means relative to the supporting surface on the body, and transmitting means through the supporting means to permit the body acting means to apply force on the body, wherein the improvement comprises:

the body acting means having a counter-balance arm including a mass mounted on the arm, means attached to the arm means and the body acting means for applying the weight of the mass as an upward force on the body acting means to urge the body acting means against the body at a predetermined force, and further comprising rails on the therapy table below the supporting surface, the body acting means having a carriage and means on the carriage in contact with the rails for moving along the rails, roller means on the top portion of the carriage for rolling along the bottom of the transmitting means to exert force on the body through the transmitting means, roller mounting means on the top portion of the carriage for mounting the roller means on the carriage, the roller mounting means including an elongated slot having a greater vertical dimension that horizontal dimension, and vibration means mounted on the carriage for vibrating vertically the mounting means and the rollers, a reference surface on at least one of the rails, the reference surface having alternating reflecting and absorbing bands aligned in the direction of travel of the carriage, sensing means on the carriage for sensing the number of alternating reflecting and absorbing bands, and processor means for comparing the counted number of a reference number for determining the position of the body acting means on the therapy table.

2. The therapy table of claim 1 further comprising mass adjusting means connected to the mass for moving the mass along the counterbalance arm to adjust the force of the body acting means against the body.

3. The therapy table of claim 2 further comprising mass control means operably connected to the mass adjusting means for controlling the actuating of the mass adjusting means during movement of the body acting means by the motive means.

4. The therapy table of claim 1 wherein the body acting means comprises at least one roller urged against the body, an upper bracket having at least one opening for supporting an axle of the roller, a shaft extending through the upper bracket, and support arm means extending from the shaft to the counterbalance arm to transmit vertical movement of the roller to pivoting movement of the counterbalance arm.

5. The therapy table of claim 4 further comprising a vibrating motor, and support means for supporting the vibrating motor to the upper bracket for vibrating the rollers.

6. The therapy table of claim 5 wherein the shaft extends through an opening in the upper bracket having an inside dimension greater than the outside dimension of the shaft to permit the upper bracket to move relative to the shaft when the motor is vibrating.

7. The therapy table of claim 6 wherein the opening in the upper bracket through which the shaft extends is elongated in the vertical direction to facilitate vertical movement of the upper bracket and minimize horizontal vibrations of the upper bracket.

8. The therapy table of claim 1 further comprising a reference surface adjacent to a portion of the body acting means, the reference surface having alternating reflecting and absorbing bands aligned in the direction of travel of the body acting means, sensing means on the body acting means for counting the number of alternative reflecting and absorbing bands, and processor means for comparing the counted number to a reference number for determining the position of the body acting means on the therapy table.

9. In a therapy table comprising a supporting surface for supporting the body of a person to be treated, body acting means at least a portion of which is below the supporting surface for acting on the body, motive means below the supporting surface for moving the body acting means relative to the supporting surface on the body, and transmitting means through the supporting means to permit the body acting means to apply force on the body, wherein the improvement comprises:

the body acting means having a counter-balance arm including a mass mounted on the arm, means attached to the arm means and the body acting means for applying the weight of the mass as an upward force on the body acting means to urge the body acting means against the body at a predetermined force, wherein the body acting means has a shell, the counterbalance arm being attached for pivoting relative to the shell, the body acting means having roller for applying force to the patient, the rollers being supported by supporting arm means extending downward from the rollers, connecting means between a portion of the counterbalance arm and the supporting arm for pivoting the supporting arm and the counterbalance arm relative to each other when the counterbalance arm pivots relative to the shell.

10. The therapy table of claim 9 further comprising linkage means extending between the shell and the supporting arms for maintaining the supporting arm in a vertical orientation when the counterbalance arm pivots.

11. In a therapy table comprising a supporting surface for supporting the body of a person to be treated, body acting means at least a portion of which is below the supporting surface for acting on the body, motive means below the supporting surface for moving the body acting means relative to the supporting surface on the body, and transmitting means through the supporting means to permit the body acting means to apply force on the body, wherein the improvement comprises:

the body acting means having a counter-balance arm including a mass mounted on the arm, means attached to the arm means and the body acting means for applying the weight of the mass as an upward force on the body acting means to urge the body acting means against the body at a predetermined force, and the counterbalance arm comprising a pair of laterally spaced C-shaped brackets and means between the brackets for attaching the brackets to each other, a mass, and means on the mass for supporting the mass on the C-shaped brackets and mass moving means attached to the mass for moving the mass along the C-shaped brackets.

12. In the therapy table of claim 11, the mass having a central opening, the mass moving means comprising a threaded rod extending laterally parallel to the C-shaped bracket members and extending through the opening in the mass, a traveler threaded onto the threaded shaft and fixed to the mass, and rotating means attached to the threaded shaft for rotating the threaded shaft to cause the traveler and the mass to move relative to the C-shaped brackets.

* * * * *